US005501452A

United States Patent [19]

Halvorson

[11] Patent Number: 5,501,452

[45] Date of Patent: Mar. 26, 1996

[54] PUTTING TRAINING DEVICE USING MUSCLE MEMORY

[76] Inventor: Glen A. Halvorson, 10101 N. Arabian Trails #1031, Scottsdale, Ariz. 85258

[21] Appl. No.: 265,652

[22] Filed: Jun. 24, 1994

[51] Int. Cl.[6] ..... A63B 69/36

[52] U.S. Cl. ..... 273/35 R

[58] Field of Search ..... 273/35 R, 183.1, 273/184 R, 185 C, 185 D, 184 A, 184 B, 192, 191 B, 195 R, 196, 197 R, 197 A, 198, 200 R, 200 A, 200 B

[56] References Cited

U.S. PATENT DOCUMENTS

| | | | |
|---|---|---|---|
| 1,581,402 | 4/1926 | Penfrase | 273/200 B |
| 1,679,546 | 8/1928 | Sas | 273/185 C |
| 2,858,133 | 10/1958 | Self | 273/192 |
| 3,073,602 | 1/1963 | Bell | 273/192 |
| 3,471,155 | 10/1969 | Donaldson | 273/186.1 |
| 3,830,504 | 8/1974 | Koo | 273/185 C |
| 3,870,314 | 3/1975 | Bertucci | 273/195 R |
| 3,955,815 | 5/1976 | Deschesnes | 273/200 B |
| 4,353,556 | 10/1982 | Self | 273/186 A |
| 4,620,708 | 11/1986 | Meyer et al. | 273/192 |
| 4,634,131 | 1/1987 | Vella | 273/192 |
| 4,944,518 | 7/1990 | Flynn | 273/191 B |
| 4,984,802 | 1/1991 | Barraclough | 273/192 |
| 5,125,665 | 6/1992 | Sindelar | 273/192 |
| 5,150,904 | 9/1992 | Sindelar | 273/192 |
| 5,246,233 | 9/1993 | Sheltman | 273/186.1 |

FOREIGN PATENT DOCUMENTS

| | | | |
|---|---|---|---|
| 1315678 | 5/1973 | United Kingdom | 273/186.1 |

*Primary Examiner*—Vincent Millin
*Attorney, Agent, or Firm*—Sandra L. Etherton

[57] ABSTRACT

A putting training device and method for training a golfer's muscles to learn, recall and follow the proper putting swing. The training device has a rigid guide rail from which a vertical plate extends perpendicularly. The face of the putter head is held against the vertical plate to insure the face is held perpendicular to the intended trajectory of the golf ball. As the putt swing is made, the plate slides in channel of guide rail, tensioned by elastic band or similar stretchable material. The method is repeated until a swing of similar trajectory can be made without the aid of the putting training device. The device may include a gripping device on the guide rail to secure the training device to the putting surface.

6 Claims, 3 Drawing Sheets

PUTTING TRAINING DEVICE USING MUSCLE MEMORY

BACKGROUND OF THE INVENTION

This invention relates generally to training devices and methods for amusement devices involving golf swings. In particular, this invention relates to a training device and method to improve putt strokes by employing proprioceptive neuromuscular facilitation. With the use of this device, the muscles of a golfer are trained to reproducibly generate a proper golf club head alignment and pendulum or piston swing, resulting in a more accurate and consistent putting stroke.

The key to making a golf ball follow an intended trajectory is to strike the ball such that the face of the golf club is perpendicular to that intended trajectory. For putting, this square stroke is achieved by drawing the putter straight back, following straight through to the ball along the intended trajectory. In this orientation, the force of the putter is transferred directly to the ball, without imparting angular momentum to the ball, thus preventing unwanted spin or causing the ball to verr to the right or left. This orientation, however, is often difficult to achieve because of opposing factors which tend to cause the putter face to strike the ball at an angle. These factors include excessive wrist action, the greater strength of one hand over the other, poor eye-hand coordination, or not accurately estimating the perpendicularity of the putter to the intended trajectory of the ball. Achieving a square stroke requires proper training and practice.

Prior art devices for training have relied on the practice of swinging a club in a guide or channel, with no resistance on the muscles and no effective way of keeping the putter face square to the intended trajectory of the ball. The theory behind these devices relies on the golfer being able to keep the club face perpendicular to the intended trajectory, without aid from the device. Thus the golfer is left to his own talents to perfect the key to a square stroke.

For example, Sindelar describes a golf putting training device in U.S. Pat. Nos. 5,152,534; 5,150,904; 5,125,665; and 5,072,943 having a guide rail and a putter stabilizer. The putter stabilizer is essentially a bracket having straight edge and is attached to the head of the golf club. The guide rail is placed parallel to the intended trajectory of the ball and the putter is swung while holding the putter stabilizer against the guide rail. While helping to guide a stroke parallel to the intended trajectory of the ball, the invention does not assist the golfer in keeping the face of the putter square to the intended trajectory of the ball; the head of the club may rotate out of a perpendicular position. In addition, this invention has the disadvantage of requiring the putter stabilizer to be attached to the golf club. The additional piece of equipment adds weight to the club, shifts its center of mass, and does not accurately represent playing conditions. Therefore, muscle and sensory modalities for actual playing conditions are not accurately represented and training is ineffective.

In U.S. Pat. No. 4,353,556, Self describes a golf swing training device in which elastic bands are attached to the golf club to put tension on the swing and thereby guide it along a proper trajectory. However, this device does not have a means for insuring that the face of the club is perpendicular to the intended trajectory of the ball.

These venerable training methods requiring the golfer to essentially teach himself, by necessarily knowing the feel of a perpendicular club face before he has actually been taught it. This leaves much room for method improvement. Fortunately, new training methods have evolved from research into rehabilitation of injury to athletes. Proprioceptive neuromuscular facilitation, or PNF, is a medical term that is used to describe specific therapeutic exercises designed by clinicians to facilitate voluntary muscle contractions and controlled body movements in patients with impaired motor function from either neuromuscular disease or musculoskeletal injury. Skeletal muscle has an intrinsic monitoring system of sensory receptors in muscle, tendon, and joint capsules that form a sensory-motor feedback loop system with the central nervous system to control muscle function. Sensory input monitors the length, tension, and position of muscles and helps to control the speed, duration and intensity of motor effort through both positive and negative feedback loops.

PNF training techniques are based on this knowledge of how muscle contractions can be influenced by changing the amount of sensory stimulus to the sensory-motor feedback loop system. In its simplest form, voluntary muscle contractions or patterns of movements can be facilitated by applying stretching and/or resistance to specific muscle groups to enhance repetitive contractions of the target muscle. PNF exercises have been shown, for example, to restore muscular coordination, control and balance much quicker during rehabilitation of the injured athlete than just isolated range-of-motion and strengthening exercises. Protocols are individualized to facilitate desired movements in quality and quantity when a muscle is prestretched. Supportive muscles are required to contract in proper sequence when resistance is applied during re-education of a specific sports movement.

This invention utilizes PNF theory to train muscles of a golfer to reproducibly generate a proper golf club head alignment and pendulum or piston swing, resulting in a more accurate and consistent putting stroke. Therefore, it is an object of this invention to provide a device and method using PNF theory for training a golfer to strike a ball such that the face of the club hits the ball perpendicularly to the intended trajectory of the ball. It is another object of this invention to provide a device and method to help a golfer develop a more consistent and accurate putting stroke by enhancing muscle memory. It is another object of this invention to increase awareness of the putter head, resulting in improved tempo, distance, and directional control. It is another object of this invention to improve awareness of hand-position, shoulder rotation, and stabilizing of the lower body. It is a further object of this invention to provide a lightweight, portable training device that can be carried in a golf bag.

These objectives are achieved with the embodiments described below and in the accompanying drawings. Variations and modifications which are in the spirit of this invention and known to those skilled in the art are considered to fall within the scope of this patent.

SUMMARY OF THE INVENTION

This invention is a device and method for training a golfer's muscles to learn and recall the proper putting swing by developing a square stroke using proprioceptive neuromuscular facilitation. The training device rests on the horizontal putting surface and consists of a vertical plate that slides within a slot cut lengthwise in a rigid guide rail. The vertical plate is tensioned by a spring or elastic band such that there is resistance to both the forward and back swing.

To learn a proper stroke in which the club face is held perpendicular to the intended trajectory of the golf ball, the putt training device is placed parallel to the intended trajectory of the ball. At the ball address position, the face of the putter is placed against the tensioned vertical plate. The putting stroke is initiated by allowing the plate under light tension to draw the putter straight back, parallel to the guide rail. The club is then swung forward against the tensioned vertical plate, maintaining the club face flush against the vertical plate. The amount of tension increases as the club is swung to its full forward position.

As the putt swing is made, the plate slides in the slot of the guide rail, tensioned by the elastic band. The swing is then repeated, keeping the face of the putter flush against the vertical plate, until a swing of similar trajectory can be made without the aid of the putting training device. The device may include a gripping device on the guide rail to secure the training device to the putting surface.

DESCRIPTION OF THE PREFERRED EMBODIMENTS

In accordance with the preferred embodiment of the present invention, as illustrated in FIGS. 1–7, there is provided a training device and method to improve putt strokes by employing proprioceptive neuromuscular facilitation.

Figure 1:
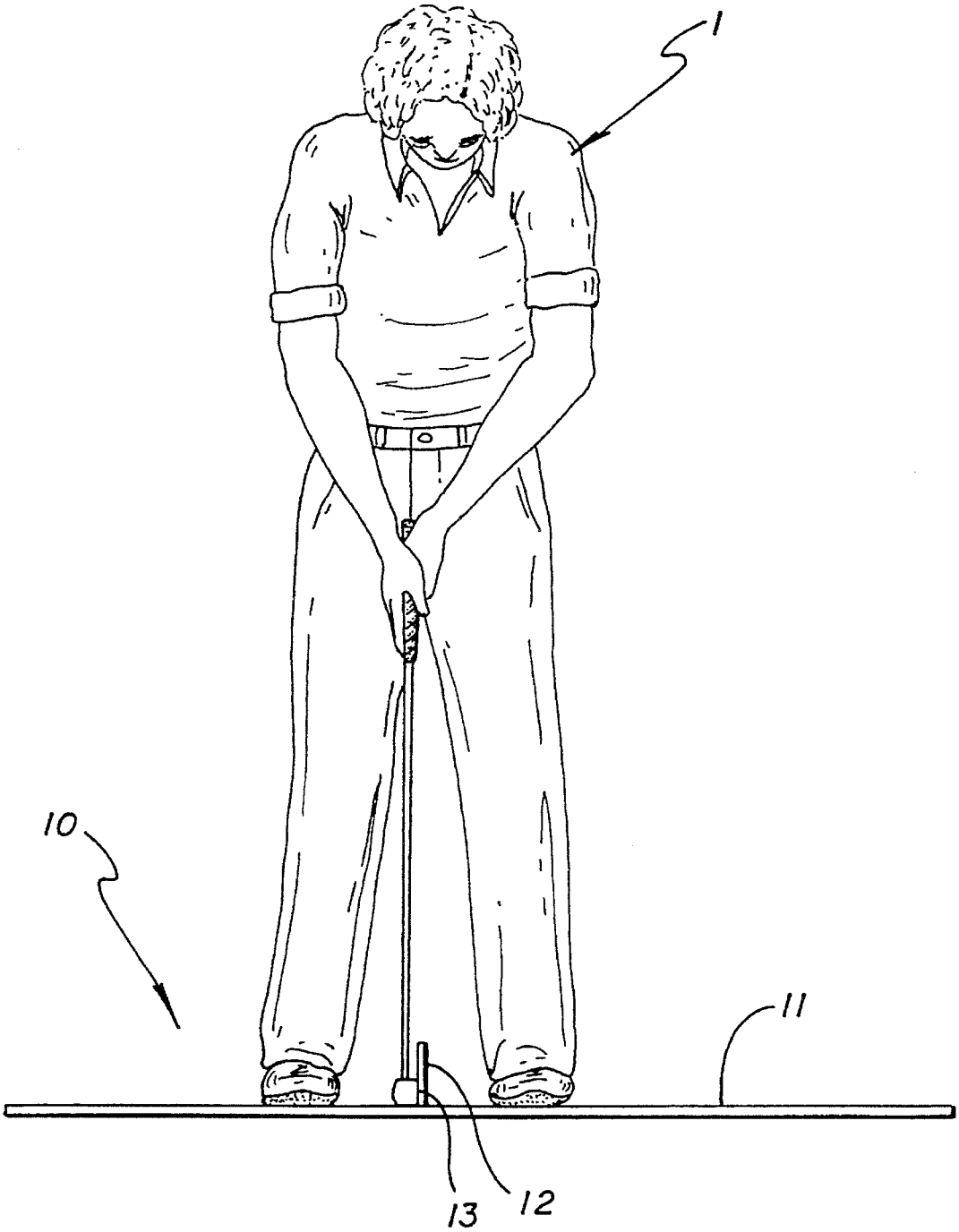
FIG. 1 illustrates a golfer addressing the putt training device.

FIG. 1 illustrates a golfer 1 addressing the putt training device 10. The device 10 is placed on or parallel to the intended trajectory of the ball or "target line." The guide rail 11 is positioned such that the vertical plate 12 will be under light tension at the ball address position. The golfer 1 stands facing the guide rail 11 and places the putter face 13 flush against the vertical plate 12. The putting stroke is initiated by allowing the plate to draw the putter straight back from the target line. This prestretches the muscles, which will then be contracted to advance the putter during the forward swing.

Figure 2:
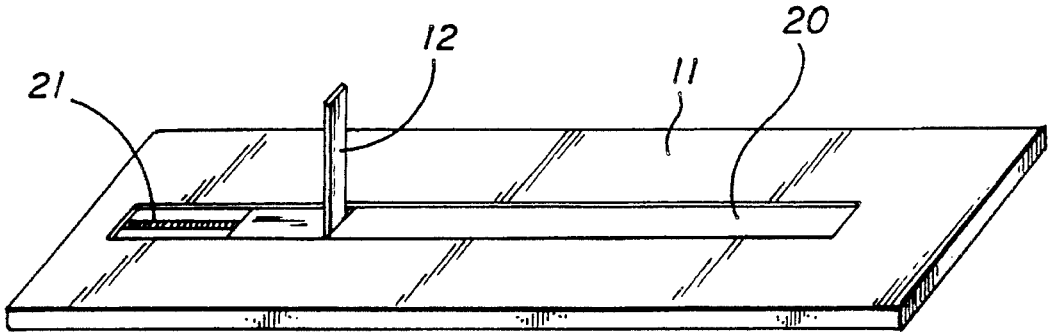
FIG. 2 is a perspective view of the putt training device.
Figure 3:
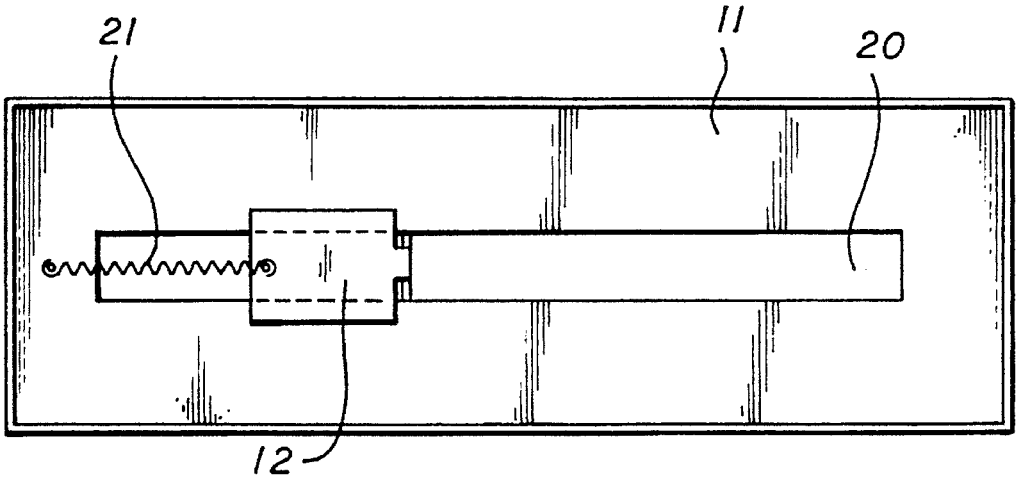
FIG. 3 is a bottom view of the putt training device.
Figure 4:
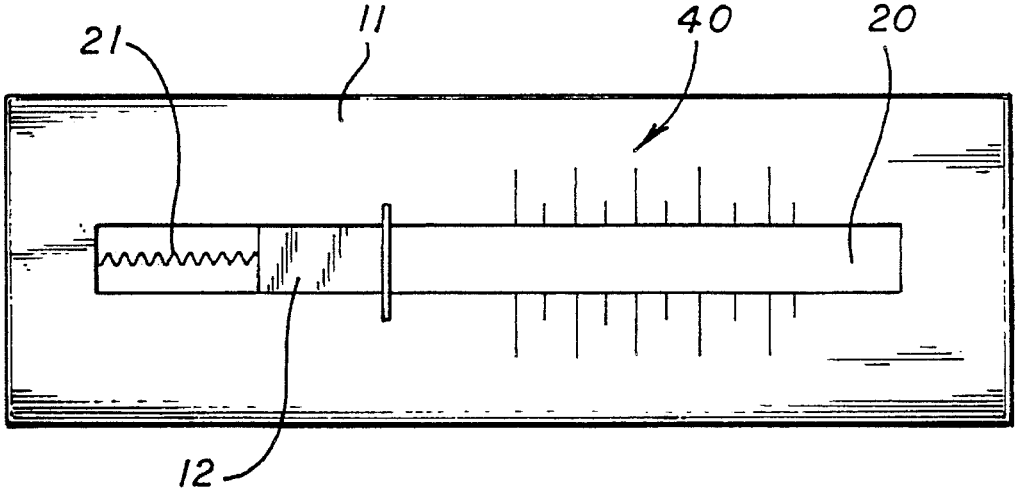
FIG. 4 is a top view of the putt training device.

The forward swing is made, holding the putter face 13 flat against the tensioned vertical plate 12 throughout the stroke, insuring that the ball will be hit squarely. As shown in FIGS. 2–4, the vertical plate 12 travels in a channel or slot 20 cut into the guide rail 11, which insures that the stroke will be parallel to the target line throughout the stroke. The finish of the stroke is then maintained for a short period of time, preferably 15–30 seconds, with the putter held statically against the plate resistance.

The entire sequence can be repeated, preferably for 5–15 minutes, followed by free-stroke rehearsal without resistance. Stroke rehearsal following the static hold creates a sensation of the putter head being pulled, as if by magnetic force, back and forth throughout the entire stroke with little or no voluntary effort on the part of the golfer. This is the beginning of true muscle memory for a perfect pendulum or piston stroke. Maximum results are achieved by daily repetition, preferably 5–15 minutes, for at least 21 days in a row. Periodic review of at least once weekly will help to then maintain the newly acquired muscle memory pattern.

Figure 5:
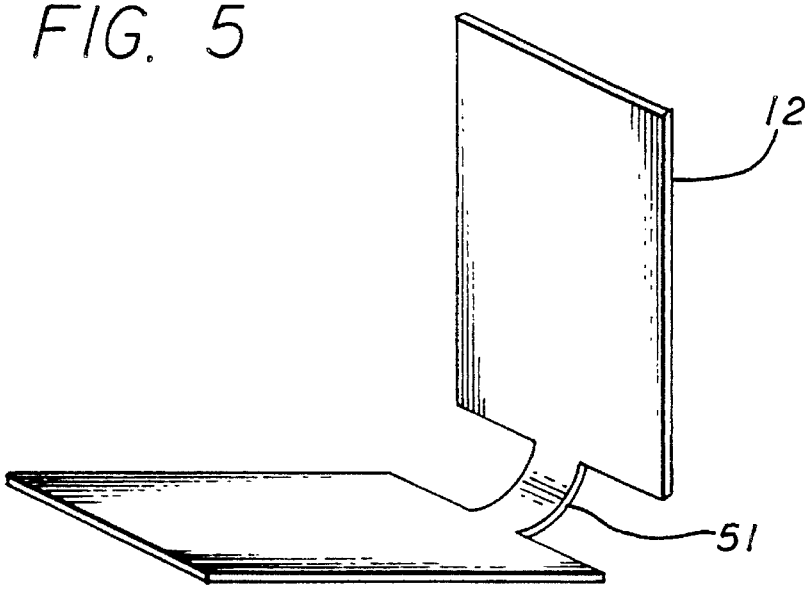
FIG. 5 is a perspective view of the vertical plate of the device.
Figure 6:
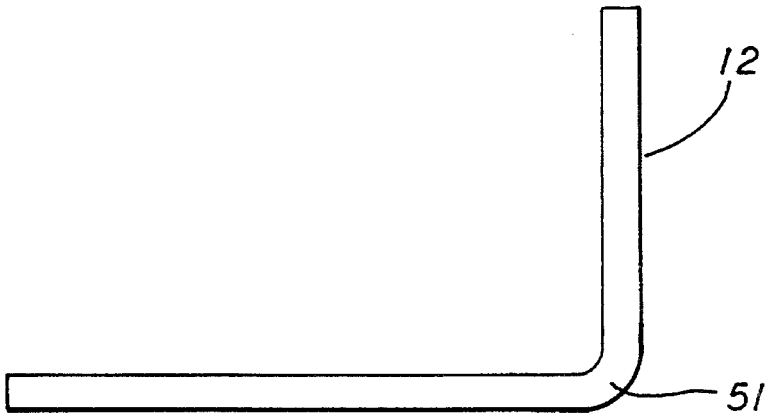
FIG. 6 is a side view of the vertical plate of the device.
Figure 7:
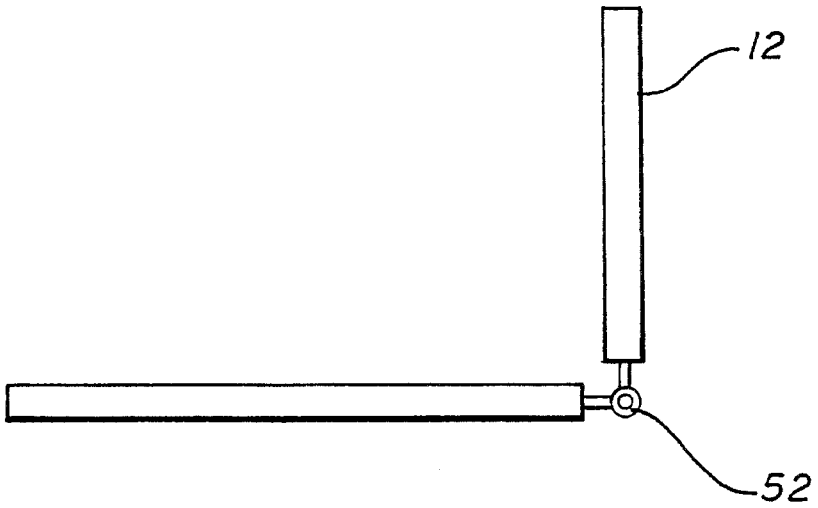
FIG. 7 is a side view of a hinged embodiment of the vertical plate.

Preferably, the guide rail 11 is made of aluminum, although other lightweight materials may be used such as plastic or other metal. As shown in FIG. 5, the preferred form of the vertical plate 12 is an L-shaped element that is narrower at the bend 51 of the L to fit in the slot 20 of the guide rail 11. If a more compact version is desired, the vertical plate 12 may be hinged at the bend 52 to open into a flat position. In addition, the guide rail 11 can be designed of telescoping sections that collapse into a shorter package. Use of lightweight materials and compactness allows the device to be easily carried in a golf bag or suitcase, for convenient practice anywhere: at home, on the green, or on a putting green, for example.

The tension on the vertical plate can be achieved by attaching a tensioning means to the vertical plate and to the guide rail. The tensioning means can be an elastic band, pneumatic piston, hydraulic piston, or spring 21, as shown in FIGS. 2–4, or any other means that allows the vertical plate 12 to provide a resistive force against the putter head when pushed away from its original position, and then return to its original position. The amount of tension increases with the length of stroke. This enhances the sensory-motor feedback loop throughout the stroke and also accommodates variable strength in the golfer by varying the length of the stroke for different length putts. Incremental marks 40 on the top surface of the guide rail 11 indicate the stroke length.

For use indoors, the device can be held in place on the putting surface by securing it to heavy or permanent objects such as walls or furniture. For example, the device may be secured between two heavy chairs so that it does not move during practice. Optional hooks (not shown) at the end of the device can be used to secure the device to such objects. For outdoor use, the same optional hooks can be used to secure the device between heavy or permanent objects, such as trees, or a pin means can be pushed through optional holes (not shown) in the guide rail 11 to secure the device to the ground. Golf tees are particularly suitable for pinning the device to the green.

I claim:

1. A portable putting training device comprising:

a rigid guide rail having a first end and a second end;

a lengthwise slot within the guide rail;

the guide rail resting on a putting surface, positioned parallel to a trajectory of a golf ball;

a plate extending perpendicularly above the guide rail, the plate slidably mounted to the guide rail such that the plate travels within the lengthwise slot starting from an original longitudinal position; and a tensioning means attached to the plate, wherein the tensioning means provides pressure opposing a putting stroke and returns the plate to the original longitudinal position along the guide rail.

2. A portable putting training device according to claim 1 wherein the tensioning means is a spring.

3. A portable putting training device according to claim 1 wherein the tensioning means is a resilient band.

4. A portable putting training device according to claim 1 wherein the guide rail further comprises means for securing the guide rail to the putting surface.

5. A portable putting training device according to claim 1 wherein the vertical plate reclines to a position parallel to the guide rail.

6. A method of putting training using a portable putting training device comprising:

a rigid guide rail having a first end and a second end;

a lengthwise slot within the guide rail;

the guide rail resting on a putting surface, positioned parallel to a trajectory of a golf ball;

a plate extending perpendicularly above the guide rail, the plate slidably mounted to the guide rail such that the plate travels within the lengthwise slot; and a tensioning means attached to the plate, wherein the tensioning means provides pressure opposing a putting stroke and returns the plate to an original longitudinal position along the guide rail;

holding the face of the putter against the plate and moving the putter with sufficient force against the plate to move the plate from the first end of the guide rail towards the second end of the guide rail; and repeating the steps of holding the face of the putter against the plate and moving the putter from the first end of the guide rail towards the second end of the guide rail until a consistent putting stroke, with proper orientation of the face of the putter relative to the intended putting path of the golf ball, can be made without the aid of the putting training device.

* * * * *